US007156327B2

(12) United States Patent
Noelle et al.

(10) Patent No.: US 7,156,327 B2
(45) Date of Patent: Jan. 2, 2007

(54) DEVICE FOR SPRAYING WATER WITH A THIN SEAL SUPPORT

(75) Inventors: Frédéric Noelle, Saint-Nazaire les Eymes (FR); Christian Decolin, Montbonnot (FR)

(73) Assignee: Rieter Perfojet, Montbonnot (FR)

( * ) Notice: Subject to any disclaimer, the term of this patent is extended or adjusted under 35 U.S.C. 154(b) by 192 days.

(21) Appl. No.: 10/504,198

(22) PCT Filed: Feb. 18, 2003

(86) PCT No.: PCT/FR03/00519

§ 371 (c)(1),
(2), (4) Date: Aug. 11, 2004

(87) PCT Pub. No.: WO03/070379

PCT Pub. Date: Aug. 28, 2003

(65) Prior Publication Data

US 2005/0082398 A1 Apr. 21, 2005

(30) Foreign Application Priority Data

Feb. 19, 2002 (FR) ..... 02 02069

(51) Int. Cl.
*A62C 31/02* (2006.01)
*B05B 1/00* (2006.01)
*B05B 1/14* (2006.01)
*B05B 1/34* (2006.01)

(52) U.S. Cl. ..... 239/596; 239/589; 239/590; 239/592; 239/483; 239/494

(58) Field of Classification Search ..... 239/596, 239/589, 590, 592, 533.14, 483, 494, 497
See application file for complete search history.

(56) References Cited

U.S. PATENT DOCUMENTS 3,613,999 A * 10/1971 Bentley et al. ..... 239/553.3
5,042,722 A * 8/1991 Randall et al. ..... 239/553.5
5,323,968 A * 6/1994 Kingston et al. ..... 239/449
6,000,626 A * 12/1999 Futo et al. ..... 239/74
6,164,566 A * 12/2000 Hui-Chen ..... 239/394

* cited by examiner

*Primary Examiner*—Davis Hwu
(74) *Attorney, Agent, or Firm*—Knobbe, Martens, Olson & Bear LLP

(57) ABSTRACT

The invention relates to a device for spraying water, provided with a seal support (21) arranged between the body (1) and the perforated sheet (23) and in contact with the above. The seal support is mounted such as to be able to be removed from the body (1) with the joint (20). The above finds application in the production of non-woven materials.

9 Claims, 3 Drawing Sheets

DEVICE FOR SPRAYING WATER WITH A THIN SEAL SUPPORT

Figure 1:
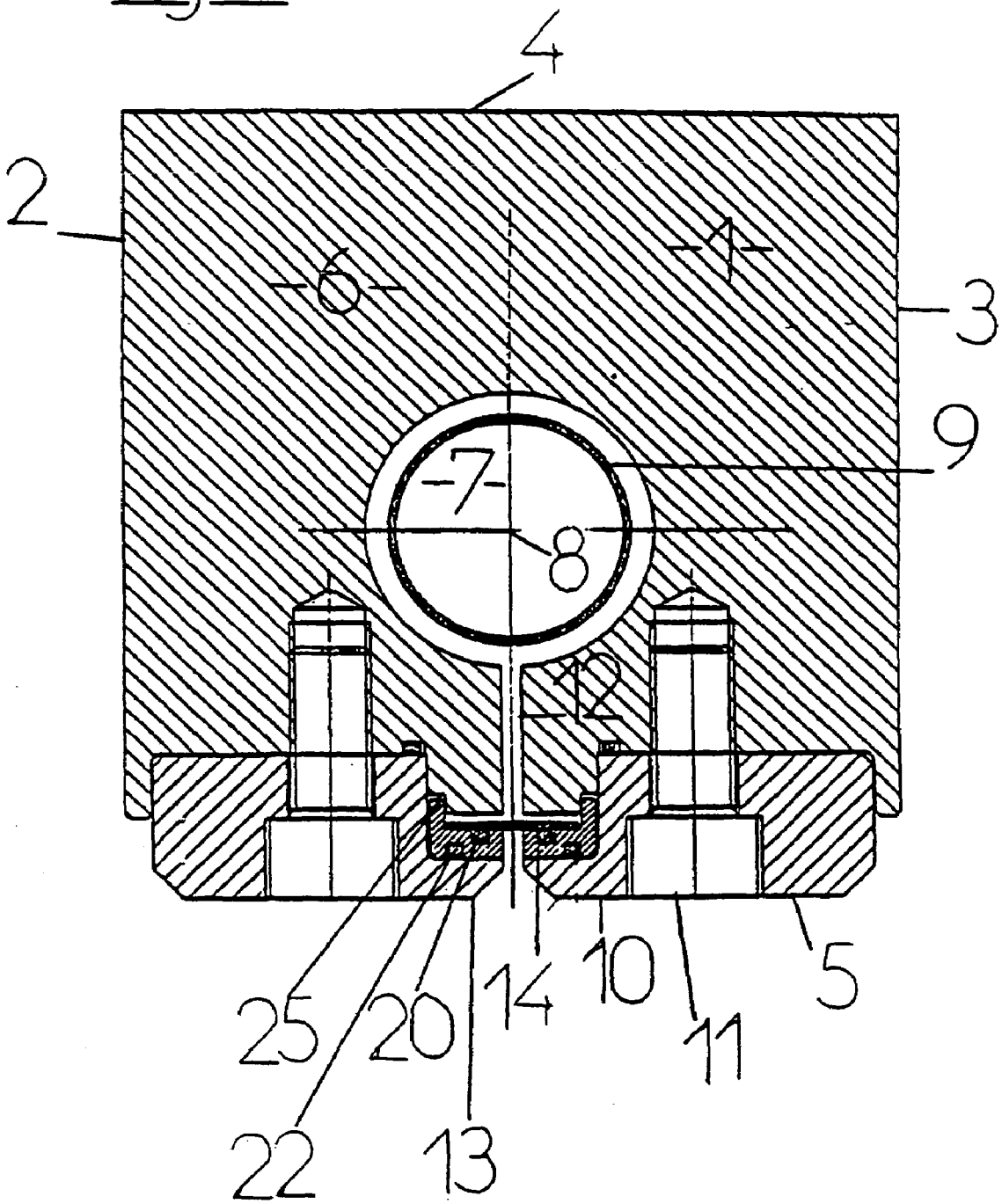

The present invention relates to a device for projecting water jets, useful in particular for the water-jet bonding of fibres in nonwovens. This bonding consists in sending a curtain of pressurized water jets onto a web of fibres in order to entangle them and form them into a coherent web without the need to use a binder or resin. Sheet material can also be bound, such as textile complexes, films, paper, wovens and knits.

In DE-A 19 921 694, a device is described for projecting water jets, comprising a pressure-resistant body delimiting an inner chamber having an inlet and communicating, with the interposition of a perforated plate, with an outlet emerging outside the body, the face of the perforated plate turned towards the outlet being in contact with a first seal housed in a first part of a seal support having a slot facing the outlet, a second seal housed in the seal support being in contact with the body.

This device is constructed and maintained quite easily. However, from experience it has proved to be inefficient in obtaining good water-jet bonding.

The invention provides a remedy for this by a device for projecting water jets which, while being easy to assemble and maintain, has great efficiency.

According to the invention, the said first part of the seal support in contact with the perforated plate has, at least close to the slot, a thickness of less than 10 mm.

It has now been understood that the inefficiency of previous devices results from the large distance between the perforated plate and the outlet. The jets lose their velocity over this large distance. By making the seal carrier thinner, this loss of velocity is prevented and efficiency is improved.

It is preferred that the thickness of the central part in the vicinity of the slot be at least 2 mm, so that the seal support has sufficient mechanical strength. Preferably, the thickness lies between 3 and 6 mm.

The seal support is mounted so as to slide in the body parallel to the axis of the inner chamber. To facilitate this movement, the said first part is a central part and continues in two thicker end parts of which the thickness increases in the direction of the inner chamber. The two end parts are in contact respectively with the longitudinal sections of the perforated plate and hold it in place. The two end parts enter by their free ends into the guiding grooves of the seal support, these grooves being provided in the body. The body extends between the two thick parts of the seal support and the spacers so that, despite the thinness of the central part, this preserves its shape even when subjected to large pressure forces. Preferably, the seal support is in the shape of a U of which the two arms shape the end parts and the core the central part.

The seals are preferably annular seals having a rectangular shape with rounded tops. Preferably, the second seal is in contact with the first part of the seal support.

The subject of the invention is also an installation for bonding fibres in a nonwoven, comprising a cylinder over which the fibres to be bonded can pass and a device according to the invention of which the jets are directed onto the lateral face of the cylinder.

Figure 2:
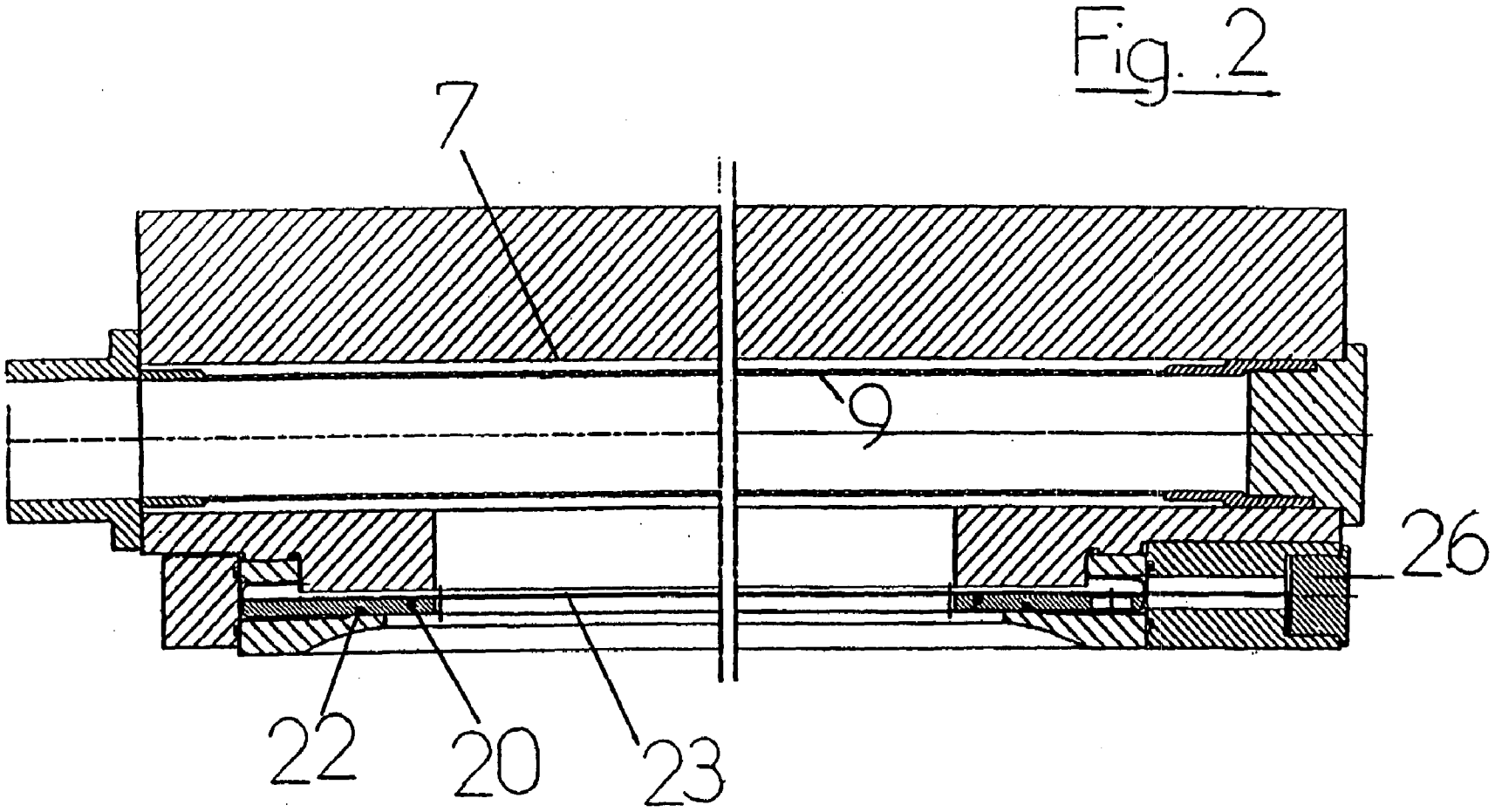
Figure 3:
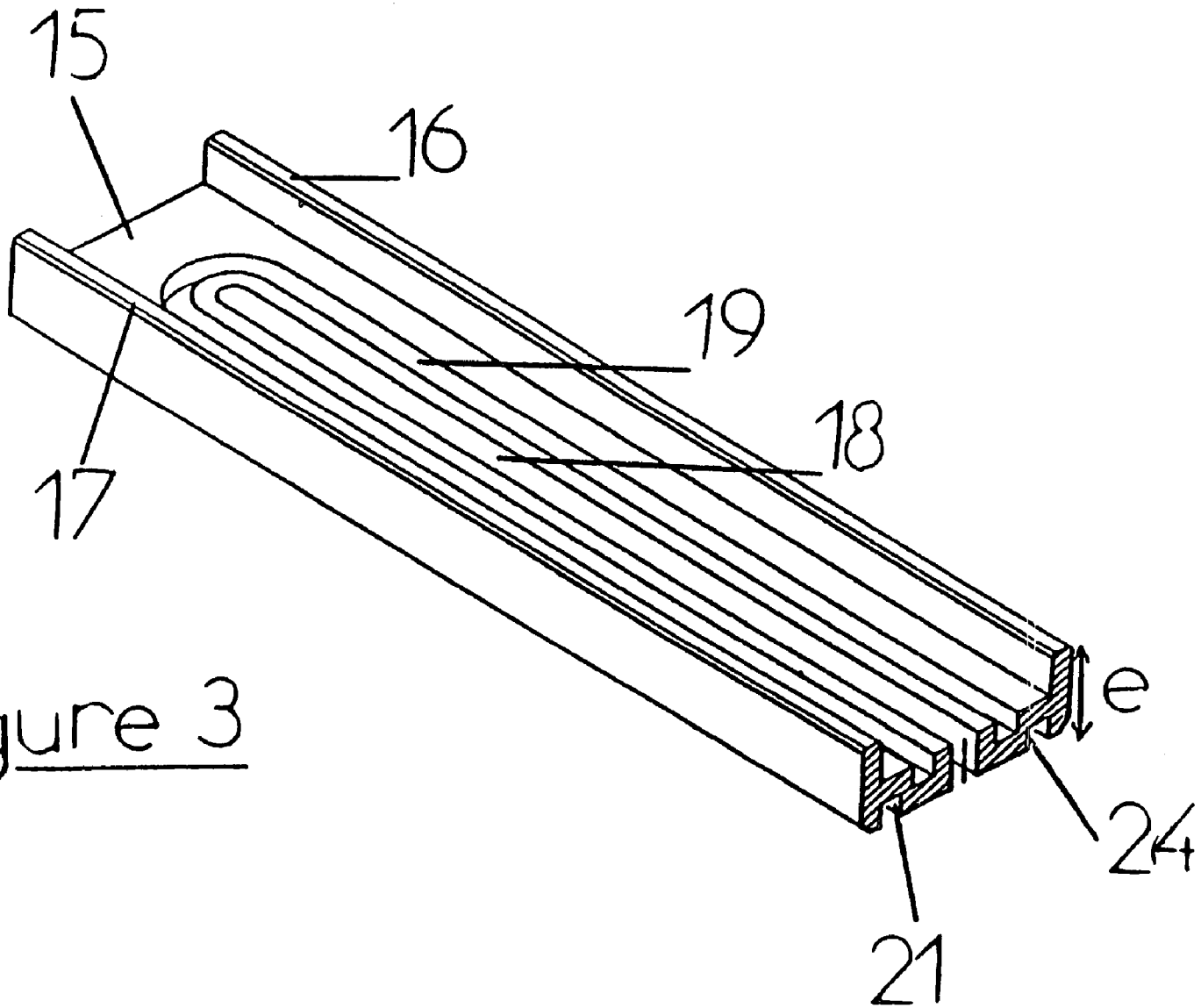

In the appended drawing, given solely by way of example:

FIG. 1 is a sectional view of a device according to the invention along a plane perpendicular to the axis of the inner chamber, FIG. 2 is a sectional view along the line II—II of FIG. 1, and FIG. 3 is a partial perspective view of the seal support.

With reference to the figures, the device for projecting jets according to the invention comprises a parallelepipedal body 1 having two large opposite faces 2, 3, two small opposite faces 4, 5 and two opposite transverse faces 6. The body 1 is made of steel. In the body 1, there is bored an oblong chamber 7 with an axis 8, which passes from one transverse face 6 to the other. Connections, not shown, are provided in the two transverse faces 6 constituting an inlet communicating with a source of pressurized water that is not shown. A cylindrical filter 9, having the same shape as the chamber 7 but with a smaller diameter, is positioned in the chamber 7.

The face 5 of the body consists of a clamp 10 that is screwed to the rest of the body 1 by screws 11.

A channel 12, in the form of a slot extending over a generatrix or over two adjacent generatrices of the chamber 7, leads from the chamber 7 to an opening 13 in the form of a slot provided in the face 5 and emerging on the outside.

The clamp 10 delimits a cavity in which a seal support 14 made of metal, plastic or composite material is housed, and composed of a central part or annular core 15, with a thickness of 5 mm, and two side arms 16, 17 (end parts) extending parallel to the axis 8 and having a thickness e that is greater than that of the core 15. The two parts 16, 17 are in contact with the longitudinal edges (parallel to the axis 8) of the perforated plate 23. The seal support 14 provides a longitudinal traversing slot 18 facing the channel 12 and the outlet 13. Either side of the slot 18, the seal support 14 includes a groove 19 turned towards the chamber 7 and in which a rectangular seal 20 with rounded tops is housed. On the opposite face, the seal support 14 includes an annular groove 21 like the groove 19 and in which a second annular seal 22 is housed. The seal 20 is closer to the slot 18 than the seal 22. On the face including the seal 20 there is positioned a perforated plate 23 with microperforations of which the diameter lies between 50 and 500 microns and, preferably, between 100 and 200 microns, which makes it possible to form water jets or needles. These perforations are positioned along a row or two rows parallel to the axis 8 and facing the slot 18.

The seal support 23 can slide in its housing parallel to the axis 8, arms 16, 17 passing in grooves 24 provided in the body 1 and can be removed from the device after a stopper 26 has been withdrawn. The same applies to the perforated plate 23. The solid part of the body 1 between the grooves 24 serves as a spacer and in this way maintains the shape of the seal support 14 in spite of its thinness by preventing it from closing when subjected to pressure forces.

In order to facilitate assembly of the device, the free ends 25 of the end parts 16, 17 of the seal support are at a certain distance from the bottom of the grooves 24. When the clamp 10 is screwed onto the principal part of the body 1, the play that exists between the ends 25 of the end parts 16, 17 of the seal support 14 and the body 1 makes it possible to carry out the screwing without danger of bottoming.

The invention claimed is:

1. Device for projecting water jets, comprising a pressure-resistant body delimiting an inner chamber having an inlet and communicating, with the interposition of a perforated plate, with an outlet emerging outside the body, the face of the perforated plate turned towards the outlet being in contact with a first seal housed in a first part of a seal support having a slot facing the outlet, a second seal housed in the seal support being in contact with the body, characterized in that the said first part of the seal support in contact with the perforated plate has, at least close to the slot, a thickness of less than 10 mm.

2. Device according to claim 1, characterized in that the said first part of the seal support has a thickness of between 2 and 10 mm.

3. Device according to claim 1, characterized in that the said first part continues in two thicker end parts, of which the thickness increases in the direction of the inner chamber.

4. Device according to claim 3, characterized in that the two end parts are in contact respectively with the longitudinal edges of the perforated plate.

5. Device according to claim 3, characterized in that the seal support is in the shape of a U of which the two arms form the end parts and the core forms the central part.

6. Device according to claim 1, characterized in that the second seal is in contact with the first part of the seal support.

7. Installation for the hydraulic bonding of a nonwoven comprising a cylinder and a device for projecting water jets, its jets begin directed onto the lateral face of the cylinder, characterized in that this device comprises the device according to claim 1.

8. Device for projecting water jets, comprising a pressure-resistant body delimiting an inner chamber having an inlet and communicating, with the interposition of a perforated plate, with an outlet emerging outside the body, the face of the perforated plate turned towards the outlet being in contact with a first seal housed in a first part of a seal support having a slot facing the outlet, a second seal housed in the seal support being in contact with the body, characterized in that the said first part of the seal support in contact with the perforated plate has, at least close to the slot, a thickness of less than 10 mm, wherein the said first part continues in two thicker end parts, of which the thickness increases in the direction of the inner chamber, and wherein the two end parts enter by their free ends into grooves for guiding and maintaining the shape of the seal support these grooves being provided in the body.

9. Device according to claim 8, characterized in that the ends of the end parts are at a certain distance from the bottom of the grooves.

* * * * *